US007942170B2

(12) United States Patent
Gruson

(10) Patent No.: US 7,942,170 B2
(45) Date of Patent: May 17, 2011

(54) INSTALLATION FOR PACKAGING A LIQUID PRODUCT IN RECEPTACLES

(75) Inventor: Bertrand Gruson, Breville sur Mer (FR)

(73) Assignee: Serac Group, Le Ferte Bernard (FR)

( * ) Notice: Subject to any disclaimer, the term of this patent is extended or adjusted under 35 U.S.C. 154(b) by 1121 days.

(21) Appl. No.: 11/602,381

(22) Filed: Nov. 21, 2006

(65) Prior Publication Data

US 2007/0113919 A1 May 24, 2007

(30) Foreign Application Priority Data

Nov. 23, 2005 (FR) ..... 05 11844

(51) Int. Cl.
*B65B 31/00* (2006.01)

(52) U.S. Cl. ..... 141/45; 141/237; 141/244; 141/290; 222/318; 222/424

(58) Field of Classification Search ..... 141/44, 141/45, 234, 237, 242, 243, 244, 285, 290; 222/318, 424

See application file for complete search history.

(56) References Cited

U.S. PATENT DOCUMENTS

| | | | | |
|---|---|---|---|---|
| 2,989,092 | A | 6/1961 | Whitecar | |
| 3,443,608 | A | 5/1969 | Copping et al. | |
| 5,480,063 | A * | 1/1996 | Keyes et al. | 222/64 |
| 2010/0071802 | A1 * | 3/2010 | Clusserath et al. | 141/44 |

FOREIGN PATENT DOCUMENTS

| | | |
|---|---|---|
| DE | 31 43 470 A1 | 8/1982 |
| EP | 0 470 398 A1 | 2/1992 |
| FR | 1 321 660 A | 3/1963 |
| FR | 2 784 669 A1 | 4/2000 |

* cited by examiner

*Primary Examiner* — Gregory L Huson

*Assistant Examiner* — Jason K Niesz

(74) *Attorney, Agent, or Firm* — Muncy, Geissler, Olds & Lowe, PLLC

(57) ABSTRACT

An installation for packaging a product in receptacles. The installation includes a series of filler stations each having a filler spout having a spout body with a top end connected to a filler spout feed duct and a bottom end provided with an orifice fitted with a controlled valve. The filler spout is fitted with a looping duct opening into the spout body above the controlled valve and connected by a link member to a general feed duct at a point between a stop valve and an isolation valve. A purge valve is connected to the general feed duct between the isolation valve and the link member.

10 Claims, 2 Drawing Sheets

INSTALLATION FOR PACKAGING A LIQUID PRODUCT IN RECEPTACLES

The present invention relates to an installation for packaging a liquid product in receptacles.

BACKGROUND OF THE INVENTION

Product-packaging installations are known that comprise a series of filler stations each having a filler spout and a support member for supporting a receptacle beneath the filler spout, in order to enable receptacles to be filled in succession with a predetermined quantity of liquid product.

In such installations, the filler spout comprises a spout body having a top end connected to a feed duct and a bottom end provided with an orifice fitted with a controlled valve.

When the installation is started up for packaging a new product, it is necessary initially to ensure that the spout bodies are filled. Given the structure of the filler spouts, that requires the filler spouts to be fed while keeping their bottom orifices open until the ducts and the spout bodies have been completely purged of the air they contained initially, i.e. until a liquid that does not contain any bubbles of air flows out through the orifices. The liquid produce flowing out through each bottom orifice is collected in a collector adjacent to said orifice. In order to ensure that bubbles of air do not rise in the filler spout feed duct, it is necessary to allow the product to flow for a relatively long length of time during which the installation is not being used for packaging the product in receptacles.

In addition, for reasons of compactness, the collector used for recovering the product during the initial filling of the filler spout is generally also used for recovering the liquid used for washing and rinsing the filler spout, which means that it is not possible to envisage reusing the product that flows out during the initial filling of the filler spouts. This thus represents a loss, not only in terms of the cost of the unused product, but also in terms of the additional cost involved in processing the various fluids recovered by the collector.

OBJECT OF THE INVENTION

An object of the invention is to propose an installation for packaging a product in receptacles that enables the product to be changed quickly while minimizing the quantity of product that is lost during such a change.

SUMMARY OF THE INVENTION

In order to achieve this object, the invention provides a packaging installation of the above-specified type in which the filler spout is fitted with a looping duct opening out into the spout body above the controlled valve and adapted to be connected selectively by a link member to the general feed duct between a stop valve and an isolation valve, and a purge duct fitted with a purge valve is connected to the general feed duct between the isolation valve and the link member.

Thus, during initial filling, the body of the filler spout is fed by the looping duct, such that the product flows in the same direction as the air held captive in the filler spout, and it suffices to deliver to the duct a quantity of product that is only very slightly greater than the combined volume of the duct and of the filler spout body to ensure that the installation is purged of the air it contained initially. This initial filling is therefore very quick and the quantity of product that is discarded is very small.

Preferably, the purge duct is connected to the general feed duct at a point immediately adjacent to the isolation valve. This minimizes the risk of any air becoming trapped in a segment of the general feed duct.

According to another aspect of the invention, the installation includes an accumulation path connected in parallel with the feed duct and including an accumulator member. This makes it possible to regulate the flow rate in the feed duct for the filler spout of each filler station, regardless of the number of filler stations in the installation.

According to another aspect of the invention, the installation includes a multiport link member comprising a first link duct connected to the general feed duct and opening out into a first chamber to which the filler spout feed duct is connected, a second link duct connected to the accumulator member and opening out into a second chamber separated from the first chamber by an intermediate partition including a communication orifice and to which the looping duct is connected, and a switch member mounted in the second chamber to move between two positions for closing either the looping duct or the communication orifice, the switch member being pierced by an opening in register with the second link duct.

It is thus possible with a single multiport link member to establish either a looped connection, or else parallel feed of the feed duct for the filler spout of each filler station both via a direct connection and via a connection passing through the accumulator member.

BRIEF DESCRIPTION OF THE DRAWINGS

Other characteristics and advantages of the invention appear on reading the following description of a particular, non-limiting embodiment of the invention described with reference to the accompanying figures, in which.

DETAILED DESCRIPTION OF THE INVENTION

Figure 1:
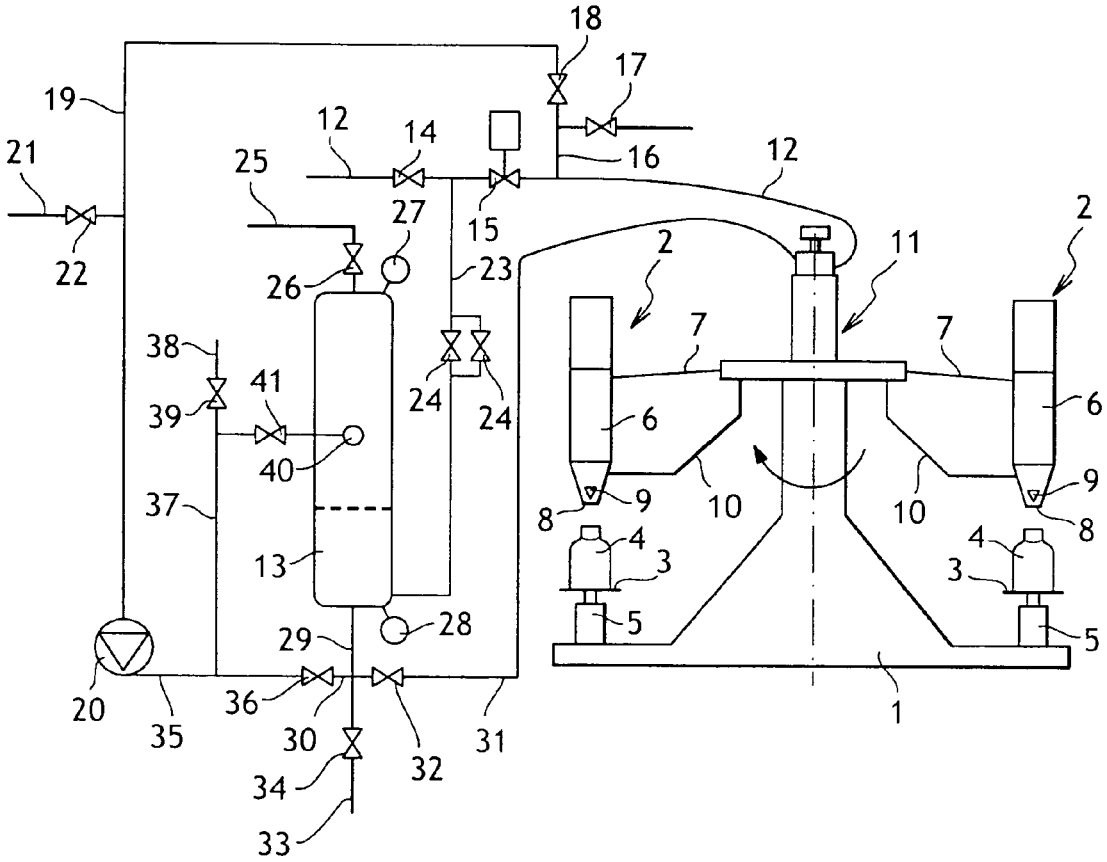
FIG. 1 is a diagrammatic overall view of an installation of the invention.

With reference to FIG. 1, the filler installation shown comprises in conventional manner a rotary carousel comprising a rotary structure 1 having filler stations mounted thereon, each comprising a filler spout 2 and a support member 3 for supporting a receptacle 4 under the filler spout, each support member 4 being associated with a weighing member 5 serving to control the corresponding filler spout in association with a control unit, not shown.

Each filler spout 2 comprises a spout body 6 having a top end connected to a filler spout feed duct 7 and a bottom end provided with an orifice 8 fitted with a controlled valve 9.

According to the invention, each filler spout 2 is also fitted with a looping duct 10 having one end secured to the spout body 6 and opening out into the spout body above the valve 9, and an opposite end connected to a multiport link member 11 of structure that is described below with reference to FIG. 2. The multiport link member 11 is connected both to a general feed duct 12 itself connected to a feed vessel (not shown), and also to an accumulation path connected in parallel with the feed duct 12 and including an accumulator member 13. The general feed duct 12 is fitted with a stop valve 14 and an isolation valve 15 connected between the stop valve 14 and the multiport link member 11.

A purge duct 16 is connected to the general feed duct 12 between the isolation valve 15 and the multiport link member 11 at a point that is immediately adjacent to the isolation valve 15. The purge duct 16 is fitted with a purge valve 17 via a T-connection having a branch opposite to the connection between the purge duct 16 and the general feed duct 12 carrying a valve 18 that is mounted on a wash loop duct 19 connected to a wash pump 20. A duct 21 for feeding air under pressure is also connected to the wash loop duct 19 via a valve 22.

The accumulation path comprises a first duct 23 having a top end connected to the general feed duct 12 between the stop valve 14 and the isolation valve 15, and a bottom end connected to the bottom end of the accumulator member 13 via two valves 24 connected in parallel in the duct 23. At its top end, the accumulator member 13 is connected to a duct 25 for feeding air under pressure via a valve 26. The accumulator member 13 is fitted at its top end with a first pressure gauge 27 and at its bottom end with a second pressure gauge 28. The accumulation path further comprises a second duct 29 having one end connected to the bottom end of the accumulator member 13 and an opposite end connected to a cross connection 30. The cross connection 30 is connected to the multiport link member 11 by a third duct 31 having a valve 32 mounted therein. A purge duct 33 is also connected to the cross connection 30 via a valve 34.

The wash circuit further comprises a second duct 35 connected both to the pump 20 and to the cross connection 30 via a valve 36. The wash circuit also comprises a third duct 37 having one end connected to the duct 35 between the wash pump 20 and the valve 36, and a second end connected firstly to a washing liquid feed duct 38 via a valve 39 and secondly to a wash head 40 via a T-connection with the branch connected to the wash head 40 being fitted with a valve 41.

Figure 2:
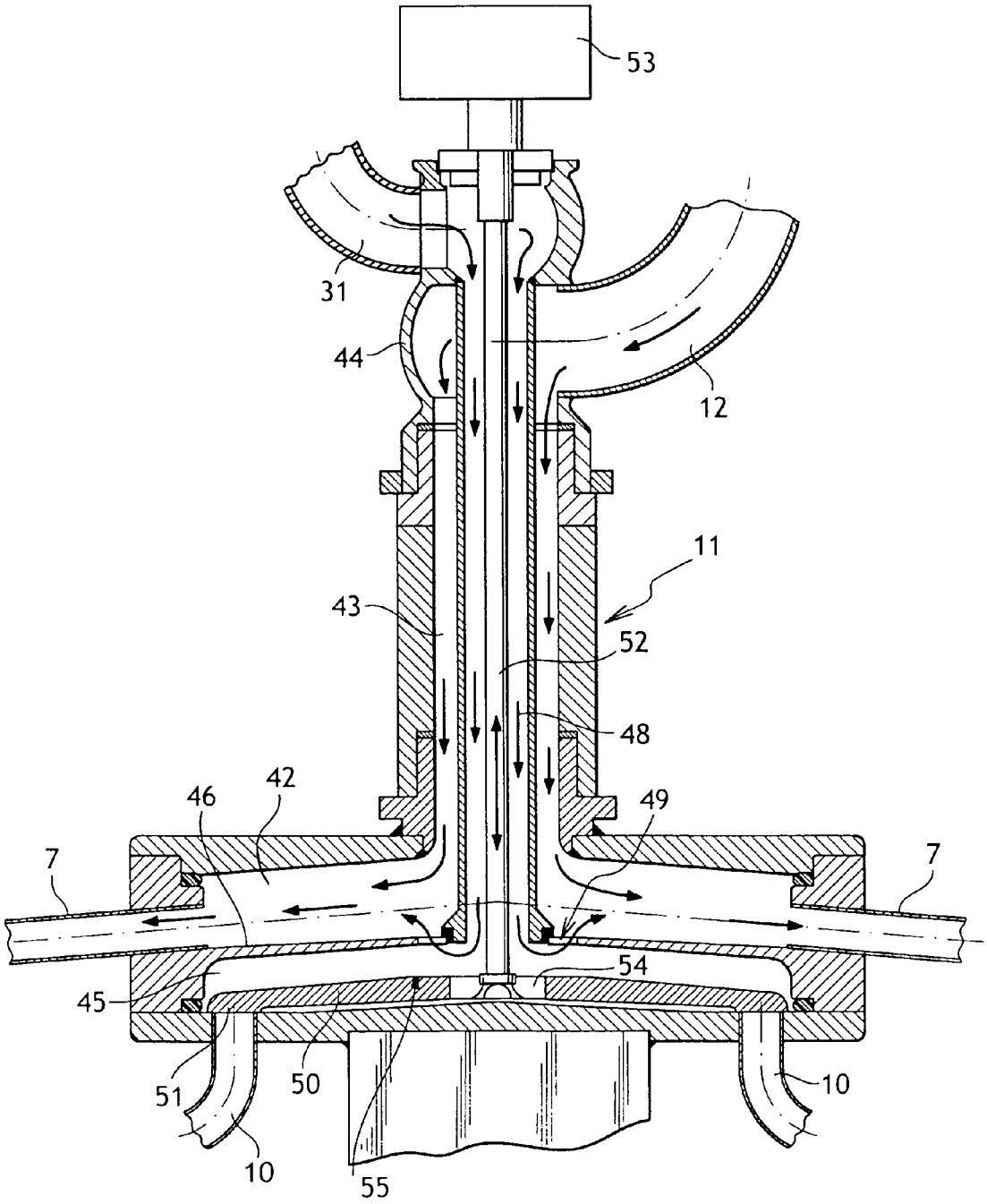
FIG. 2 is a diagrammatic axial section view on a vertical plane through a multiport link member of the invention.

With reference to FIG. 2, the multiport link member 11 comprises in conventional manner a first circular chamber 42 to which the feed ducts 7 for the filler spouts 2 of the various filler stations are connected in a regular distribution around an axis of symmetry of the multiport link member 11. Also in conventional manner, the first chamber 42 is connected via a first link duct 43 to the general feed duct 12 via a rotary coupling 44.

According to the invention, the link member further comprises a second chamber 45 on the same axis as the first chamber 42 and extending under the first chamber, being separated therefrom by an intermediate partition 46. A second link duct 48 is secured to the intermediate partition 46 and extends coaxially inside the first link duct 43. The bottom end of the duct 48 is secured to the intermediate partition 46 by radial arms that define around the duct 48 an opening 49 through the intermediate partition 46. The top end of the duct 48 is connected to the inside of the rotary coupling 44 so as to provide a connection with the duct 31 of the accumulation path. The looping ducts 10 from the various filler spouts open out into the bottom wall of the second chamber 45. A switch member in the form of a circular plate 50 is mounted concentrically inside the second chamber 45 and has on its bottom face projecting studs 51 extending in register with each of the looping ducts 10. The position of the switch member 50 inside the second chamber 45 is determined by a control rod 52 whose top end is connected to a control member 53 and whose bottom end is connected to the switch member by radial arms defining an opening 54 through the switch member in register with the bottom end of the second link duct 48. The top face of the switch member 50 presents an annular surface 55 closing the opening 49 in leaktight manner when the switch member 50 is in a high position, pressed against the intermediate wall 46.

When the installation is started, all of the valves are closed. Starting from this position, the valve 26 is opened to admit air under pressure into the accumulator member 13 and the valves 24 are also opened. The product stop valve 14 is opened and liquid product under pressure is admitted into the accumulator member 13 by passing through the valves 24. The accumulator member 13 becomes filled progressively with liquid and the depth of the product in the accumulator member is determined by the pressure difference as measured by the pressure gauges 27 and 28. When the product reaches a predetermined level in the accumulator member 13, represented by a dashed line in FIG. 1, and corresponding to the total volume of the filler spout bodies 6 and of the filler spout ducts, the stop valve 14 is reclosed. The valve 32 on the accumulation path and the purge valve 17 are both opened and the switch member 50 is in its high position, i.e. a looped connection is provided in the spout bodies 6 between the duct 31 of the accumulation path, the looping duct 10 of the filler spouts, the feed duct 7 of the filler spouts, and the general feed duct 12. The liquid product under pressure flows initially in the duct 31 expelling the air it contains, and then passes into the second link duct 48 of the link member 11, filling successively the looping ducts 10, the filler spout bodies 6, the filler spout feed ducts 7, the first link duct 43 of the link member 11, the general feed duct 12 as far as the isolation valve 15, and the purge duct 16 as far as the purge valve 17. When the product in the accumulator member 13 reaches a level (as determined by the pressure difference between the pressure gauges 27 and 28) that corresponds to the ducts and the filler spout bodies being filled, the purge valve 17 is closed. This level is determined so that a small quantity of product has passed through when the purge valve 17 is closed, thus guaranteeing satisfactory purging of the installation. The installation is then ready to package the product in the receptacles.

The switch member 50 of the link member 11 is then lowered so as to close the ends of the looping ducts 10. The filler spout feed ducts 7 are then connected in parallel firstly to the general feed duct 12 by the first link duct 43 and the first chamber 42, and secondly to the duct 31 of the accumulation path by the second link duct 48, the second chamber 45, the opening 49, and the first chamber 42, as shown by bold arrows in FIG. 2. The product stop valve 14 is again opened as is one of the valves 24. The accumulator member 13 fills again to a point where there is equilibrium between the pressure of the liquid product in the ducts and the pressure of the air in the accumulator member 13. The isolation valve 15 is then opened and filling can be performed in conventional manner by controlling the valve 9 in each of the filler spouts. While product is being packaged in the receptacles, the flow rate in the filler spout feed ducts 7 can be adjusted by the extent to which the isolation valve 15 is opened, and also by the air pressure in the accumulator member 13. Variation in the total flow rate through the filler spout ducts 7 is compensated by variation in the level of product in the accumulator member 13 so that the flow rate is substantially constant in each of the filler spout feed ducts 7. The speed of adaptation is determined by the flow through the valves 24. In order to avoid any surge phenomenon, it is preferable for only one valve 24 to be open during this stage of operation of the installation.

When it is desired to change product, the product stop valve 14 is closed and a number of receptacles corresponding substantially to the volume of the product contained in the accumulator member 13 are filled while using the filler spouts in conventional manner. Thereafter, the isolation valve 15 is closed and then the second purge valve 34 is opened as are the air admission valves 22 and 18, while the valve 26 is closed. Air under pressure is sent into the general feed duct 12. Simultaneously, the switch member 50 of the link member 11 is returned to its high position so that the air under pressure progressively expels the product so as to purge progressively the general feed duct 12, the first link duct 43 of the link member 11, the first chamber 42, the filler spout feed ducts 7, the filler spout bodies 6, the looping ducts 10, the second chamber 45, the second link duct 48, and the duct 31 of the accumulation path. After a sufficient length of time has elapsed for said purging to take place, the valve 32 is closed and the isolation valve 15 is opened, thereby putting the pressurized air feed into communication with the duct 23 of the accumulation path, the two valves 24 then being in the open position. Air under pressure thus expels the product contained in the duct 23 and in the accumulator member 13. The valves 18, 22, and 34 are then reclosed.

If the new product for packaging is compatible with the preceding product or is a neutral product, then the initial filling of the installation and product packaging are performed as described above.

If it is desired to wash the installation, the washing liquid feed valve 39 is opened as are the valves 41 and the second purge valve 34. The wash head 40 then causes the inside of the accumulator member 13 to be cleaned and the washing liquid flows via the purge duct 33.

The valve 41 is then closed as are the valves 24, while the valve 36 is opened and air under pressure is admitted into the accumulator member 13 by opening the valve 26. The washing liquid thus penetrates into the accumulator member until it reaches a level that leads to equilibrium with the pressure of the air compressed in the accumulator member 13. The valves 36 and 39 are closed and then the valve 32 is opened together with the top purge valve 17. The washing liquid thus fills in succession the duct 31, the ducts and the chambers of the link member 11, the looping ducts 10, the filler spout bodies 6, the filler spout feed ducts 7, and the general feed duct 12 as far as the isolation valve 15. The valve 32 is then closed while the valves 24 are opened together with the isolation valve 15, thus enabling the duct 23 and the general feed duct 12 to be filled with the washing liquid.

The valves 24 are then reclosed while the valve 36 is opened as is the valve 18. The washing liquid thus fills the duct 19 of the washing circuit.

The valve 36 is then reclosed while the valve 41 is opened. The wash circulation pump 20 then causes the wash fluid to flow around a closed loop in the circuit comprising the ducts 35 and 37, the wash head 40, the accumulator member 13, the duct 23, a segment of the general feed circuit 12 extending between the duct 23 and the valve 18, and the duct 19. The valves 41, 24, and 15 are then closed while the valve 36 is opened. A new closed loop washing circuit is then established in the duct 31, the link member 11 through the filler spouts passing via the looping ducts 10, the segment of the general feed duct 12, the valve 18, and the duct 19.

Once washing has been completed, the ducting is purged by reopening the valve 22 for admitting air under pressure and the bottom purge valve 34, while also closing the valve 18. Initially the valve 36 is opened while the valve 41 is kept closed, thus ensuring that the ducts 35 and 37 are emptied. The valve 36 is then closed while the valve 18 is opened as are the isolation valves 15 and the valves 24 in order to purge the duct 23. The valves 24 are then reclosed while the valve 32 is opened in order to perform purging from the general feed duct 12 as far as the duct 31 of the accumulation path. The valve 32 is then reclosed while the valve 41 is opened again to purge the accumulator member 13.

If necessary, the filler spout endpieces are washed prior to purging the filler spouts by putting the switch member 50 of the link member 11 back into its low position while opening the valve 24 and the isolation valve 15 and also the valve 9 of the filler spouts.

The installation can be rinsed and purged under the same conditions as it is washed. The installation is then ready for packaging a new product delivered in conventional manner from a feed vessel connected in parallel to the stop valve 14 via appropriate separation valves in order to avoid communication between the feed valves.

Naturally, the invention is not restricted to the embodiment described above, and variant embodiments can be provided without going beyond the ambit of the invention as defined by the claims.

In particular, although the installation is described with reference to product being metered by weight with receptacles being supported from below, the invention also applies to filler spouts associated with supports that hold receptacles by the neck, and/or with devices for metering by volume.

Although the multiport link member of the invention is described in association with an application to looping a filler spout, the multiport link member could equally well be used in other applications, for example by connecting the duct 12 to a feed vessel for feeding a first product for packaging and the duct to a vessel containing a second product for packaging while the ducts 7 and 10 are both connected to the top portions of the filler spouts, thus enabling the receptacles to be filled at will with one or the other of the products or with a mixture thereof.

Although the configuration of an accumulation path is described in association with the multiport link member of the invention enabling a series of filler spouts to be fed simultaneously, the invention can also be implemented on a single filler spout associated with a set of simple valves associated with a network of suitably-interconnected ducts.

What is claimed is:

1. An installation for packaging a product in receptacles, the installation comprising at least one filler station having a filler spout and a support member for supporting a receptacle under the filler spout, the filler spout comprising a spout body connected to a filler spout feed duct near the top end, the filler spout feed duct connected to a general feed duct, and the spout body having a bottom end provided with an orifice fitted with a controlled valve, wherein the filler spout is fitted with a looping duct opening out into the spout body above the controlled valve and connected selectively by a link member to the general feed duct at a point between a stop valve and an isolation valve, and wherein a purge duct fitted with a purge valve is connected to the general feed duct between the isolation valve and the link member.

2. An installation according to claim 1, wherein the purge duct is connected to the general feed duct at a point immediately adjacent to the isolation valve.

3. An installation according to claim 1, wherein the link member is a multiport member having a path connected to the filler spout feed duct, a path connected to the looping duct, a path connected to the general feed duct, and a switch member arranged to feed the filler spout feed duct and the looping duct in a parallel configuration or in a looped configuration.

4. An installation according to claim 1, including an accumulation path connected in parallel with the general feed duct and including an accumulator member.

5. An installation according to claim 3, including an accumulation path connected in parallel with the general feed duct and including an accumulator member, and wherein the accumulator member includes means for measuring the presence in the accumulator member of a determined quantity of liquid.

6. An installation according to claim 3, including an accumulation path connected in parallel with the general feed duct and including an accumulator member, and wherein the multiport link member has a first duct connected to the general feed duct and opening out into a first chamber having the filler spout feed duct connected thereto, a second duct connected to the accumulator member and opening out into a second chamber separated from the first chamber by an intermediate partition including a communication orifice and to which the looping duct is connected, and a switch member mounted to move in the second chamber between two positions to close either the looping duct or the communication orifice, the switch member being pierced by an opening in register with the second duct.

7. An installation according to claim 6, the installation having a plurality of filler stations with filler spout feed ducts and looping ducts connected to a common multiport link member.

8. An installation according to claim 7, wherein the filler spout feed ducts and the looping ducts are regularly distributed about an axis of symmetry that is common to:

the first chamber;

the second chamber;

the first duct;

the second duct; and the communication orifice.

9. An installation according to claim 4, including a wash circuit connected to the general feed duct and to the accumulation path.

10. An installation according to claim 4, including a second purge valve connected to a bottom end of the accumulation path.

* * * * *